US005361553A

United States Patent [19]

Andreasson et al.

[11] Patent Number: 5,361,553

[45] Date of Patent: Nov. 8, 1994

[54] JOIST

[75] Inventors: Gunnar Andreasson, Landvetter; Ronny Glemberg, Partille, both of Sweden

[73] Assignee: Tarkett AB, Hanaskog, Sweden

[21] Appl. No.: 84,200

[22] PCT Filed: Jan. 9, 1992

[86] PCT No.: PCT/SE92/00006

§ 371 Date: Oct. 29, 1993

§ 102(e) Date: Oct. 29, 1993

[87] PCT Pub. No.: WO92/12306

PCT Pub. Date: Jul. 23, 1992

[30] Foreign Application Priority Data

Jan. 10, 1991 [SE] Sweden ..... 9100073-7

[51] Int. Cl.[5] ..... E04B 9/00

[52] U.S. Cl. ..... 52/480; 52/664

[58] Field of Search ..... 52/480, 479, 506, 669, 52/668, 481, 507, 664, 665

[56] References Cited

U.S. PATENT DOCUMENTS 4,984,404 1/1991 Fabricius .

FOREIGN PATENT DOCUMENTS 843342 8/1952 Germany .
1061500 7/1959 Germany .
8900197 2/1990 Sweden .
8602686 5/1986 WIPO .

*Primary Examiner*—Carl D. Friedman
*Assistant Examiner*—Creighton Smith
*Attorney, Agent, or Firm*—Finnegan, Henderson, Farabow, Garrett & Dunner

[57] ABSTRACT

A joist to be used as a top joist in a sporting floor in which a plurality of floor boards (1) or panels rest on a plurality of parallel top joists (3). The top joists (3) are spaced apart and rest on a plurality of parallel, spaced-apart bottom joists (4) extending substantially perpendicular to the top joists (3) and supported on a base (5) by means of blocks (6). The top joist has a narrow, upper flat surface (7) extending along the joist and adapted to engage the lower side of the floor boards or panels, and a narrow, lower flat surface (8) which extends along the joist and which is positioned directly opposite the upper flat surface and adapted to engage the upper side of the bottom joists (4). The joist has a thickness decreasing laterally outwards from these two flat surfaces (7, 8).

6 Claims, 2 Drawing Sheets

JOIST

The present invention relates to a joist adapted to be used as a top joist in a sporting floor in which a plurality of floor boards or panels rest on a plurality of parallel top joists which are spaced apart and rest on a plurality of parallel, spaced-apart bottom joists extending substantially perpendicular to the top joists and supported on a base by means of blocks.

In a prior art sporting floor of the type described above, rubber inserts are arranged between the top and bottom joists. These rubber inserts give the sporting floor the required qualities of deformation or resilience, which renders it possible to make the bottom joists more rigid and, thus, so strong that sufficient strength is imparted to the sporting floor. One problem of this prior art sporting floor is the aging of the rubber material of the inserts, which thus can become rigid or brittle, thereby losing its elastic properties.

An object of the present invention therefore is to provide a joist adapted to be used as a top joist in a sporting floor of the type described above and designed in such a manner that the sporting floor can be given both the required qualities of deformation or resilience and the required strength properties, without necessitating the use of rubber inserts.

This object is achieved by a joist which is of the type described by way of introduction and, according to the present invention, is characterised in that it has a narrow, upper flat surface extending along the joist and adapted to engage the lower side of the floor boards or panels, and a narrow, lower flat surface which extends along the joist and which is positioned directly opposite the upper flat surface and adapted to engage the upper side of the bottom joists, and that it further has a thickness which decreases laterally outwards from these two flat surfaces.

In a preferred embodiment, the joist is flat-bevelled on both sides of the upper and/or lower flat surface. The ratio of joist thickness to width preferably is 1:4–1:5.

The invention will now be described in more detail with reference to the accompanying drawings.

Figure 1:
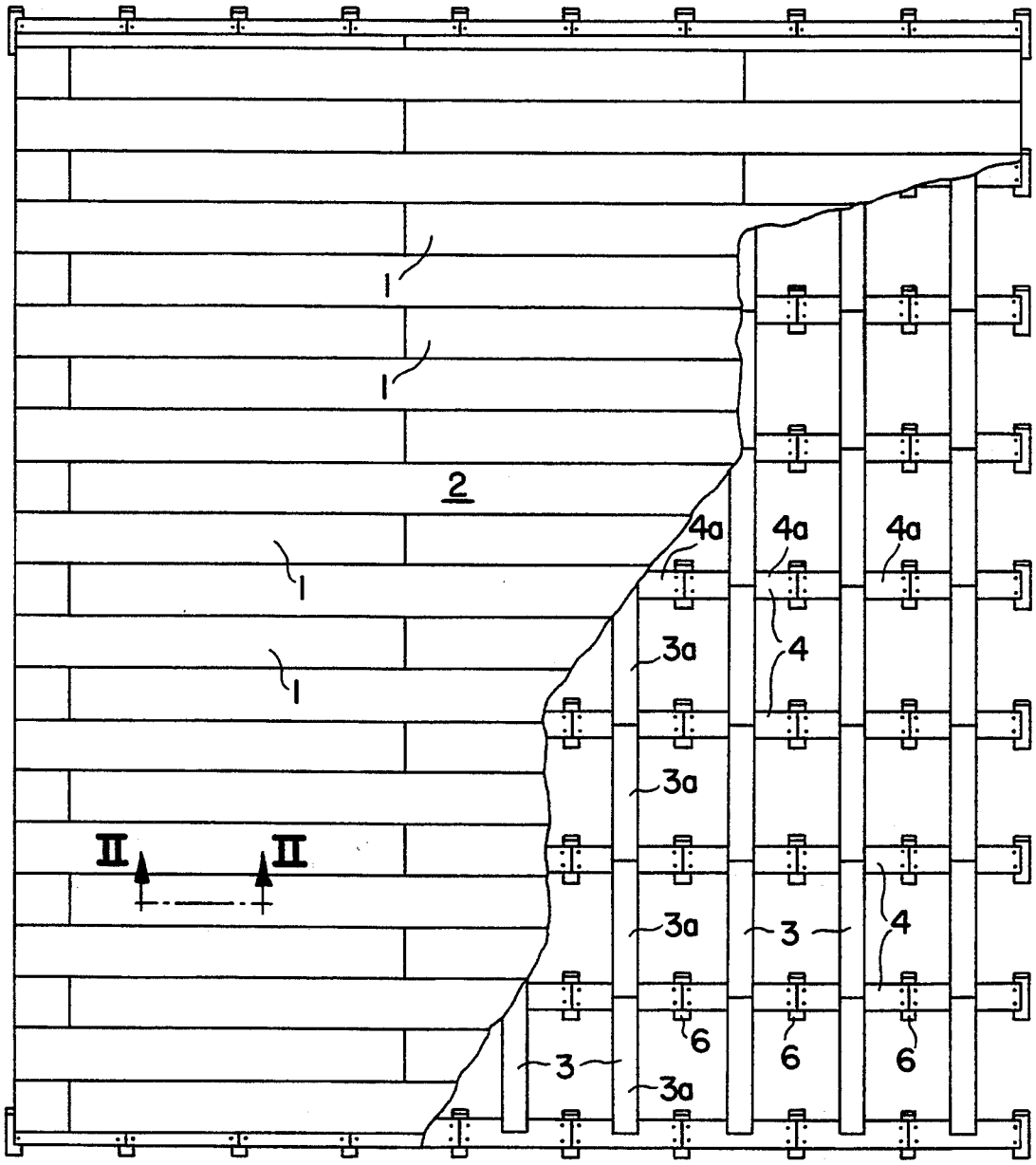
Figure 2:
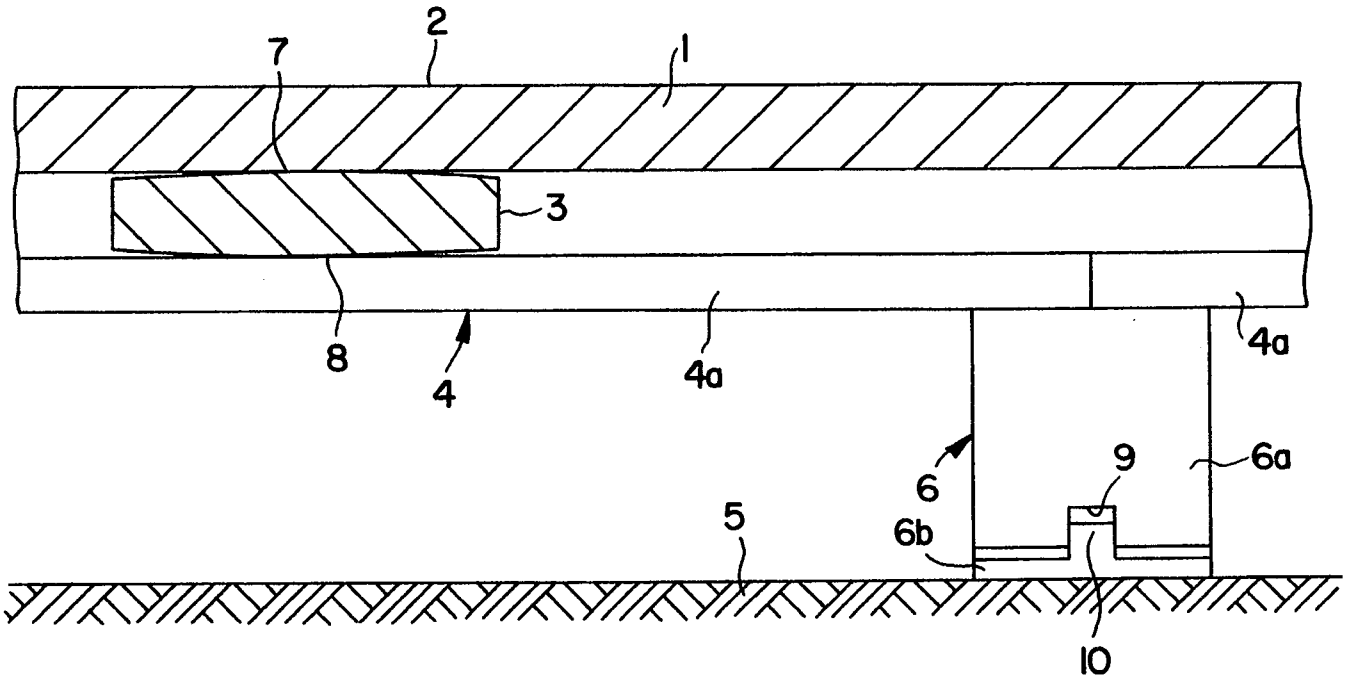

FIG. 1 is a top plan view and illustrates a sporting floor in which the joist according to the present invention is used as a top joist, and FIG. 2 is a sectional view along the line II—II in FIG. 1.

The floor illustrated in FIG. 1 comprises a plurality of parallel floor boards 1, such as parquet boards, forming the floor surface 2. The floor boards 1 rest on a plurality of parallel top joists 3 equidistantly spaced from each other and extending perpendicular to the floor boards 1. The floor boards 1 are attached to the top joists 3 by means of glue or nails.

The top joists 3 rest on a plurality of parallel bottom joists 4 which are equidistantly spaced from each other and extend perpendicular to the top joists 3, i.e. in parallel with the floor boards 1. The top joists 3 are nailed to the bottom joists 4.

The bottom joists 4 are supported on a base 5 (see FIG. 2), such as a concrete floor, by means of blocks 6 which are equidistantly spaced from each other. The center distance between the blocks 6 along the bottom joists 4 is the same as the center distance between the top joists 3, and the blocks 6 are positioned midway between neighbouring top joists 3.

In the embodiment shown in FIG. 1, each top joist 3 is composed of a plurality of joist elements 3*a* of the same length which are arranged successively and whose length is equal to the center distance between neighbouring bottom joists 4. Each joist element 3*a* extends between and rests on two successive bottom joists 4, as illustrated in FIG. 1. In the embodiment shown in FIG. 1, also the bottom joist 4 is composed of a plurality of joist elements 4*a* of the same length which are arranged successively and whose length is equal to the center distance between the blocks 6. Each joist element 4*a* extends between and rests on two successive blocks 6, as illustrated in FIG. 1.

In a preferred embodiment, the center distance between neighbouring bottom joists 4 and, consequently, also the length of the joist elements 3*a* is 500 mm, The width of the joist elements 3*a* is 95 mm and their height or thickness 22 mm. Moreover, in this preferred embodiment the center distance between the blocks 6 and, consequently, also the length of the joist elements 4*a* is 420 mm, the width of the joist elements 4*a* is 95 mm and their height or thickness 14 mm. The joist elements 4*a* are rectangular in cross-section.

According to the present invention, the rod joist 3 has a narrow, upper flat surface 7 which extends along the joist and with which the floor boards 1 engage, and a narrow, lower flat surface 8 which extends along the joist and which engages the flat upper surface of the bottom joists 4. The two horizontal flat surfaces 7 and 8 are positioned directly opposite each other in the central portion of the top joist 3. The top joist 3 has a height or thickness which slightly decreases laterally outwards from the central portion by being flat-bevelled on both sides of the central portion both on the upper side and on the lower side. In the embodiment illustrated in The drawings, the flat surfaces 7 and 8 have a width of 30 mm and, thus, each of the bevelled lateral portions has a width of 32.5 mm. In the illustrated embodiment, the bevelling angle is about 1°.

Since the top joists 3 have the cross-sectional shape described above, a narrow, strip-shaped contact surface results between the top joists 3 and the bottom joists 4, whereby the force transferred from the floor boards 1 via the top joists 3 to the bottom joists 4 is centered to the center of the joist elements 4*a*, which, in turn, implies that the bottom joists 4 can be given a height or thickness that is sufficient for the desired strength and yet produce the desired qualities of deformation and resilience.

Since the top joists 3 have the cross-sectional shape described above, the free distance between the top joists 3 can be kept small, thereby reducing the risk of treading through, at the same time as the distance between the narrow, strip-shaped contact surfaces can be kept relatively great.

In the illustrated embodiment, each block 6 consists of an upper, wedge-shaped wooden part 6*a* and a lower, wedge-shaped wooden part 6*b*. The upper part 6*a* is formed with a longitudinal groove 9, and the lower part 6*b* has a longitudinal ridge 10 engaging the groove 9. The two wedge-shaped parts 6*a* and 6*b* are displaceable relative to one another in their longitudinal direction for the purpose of adjusting the height of the block 6. As a result, the blocks 6 may be given different heights so as to compensate for any irregularities in the base 5.

A number of joists according to the present invention are included preferably as top joists in a module which is intended for the production of sporting floors and composed of top joists 3, bottom joists 4 and blocks 6 or, alternatively, block upper parts 6*a*. The size of the module. i.e. the number of top joists, bottom joists and blocks included therein, can of course be varied as desired, but in a preferred embodiment, the size of the module corresponds to a conventional loading pallet.

We claim:

1. Joist for use as a top joist in a resilient floor having a plurality of floor boards which boards rest on a plurality of parallel, spaced-apart top joists which in turn rest on a plurality of parallel, spaced-apart bottom joists that extend substantially perpendicular to the top joists and are supported on a base by means of blocks, said joist comprising a longitudinally extending joist element having a thickness between an upper and lower side thereof and a width, an upper flat surface extending along the length of the upper side of the joist element, said upper flat surface forming a relatively narrow, compared to the width of said joist element, longitudinally extending, strip-shaped contact surface adapted to be engaged with a lower side of the floor boards and a lower flat surface extending along the length of the lower side of the joist element directly opposite from said upper flat surface, said lower flat surface forming a relatively narrow, compared to the width of the joist element, longitudinally extending, strip-shaped contact surface adapted to be engaged with an upper side of the bottom joists, the thickness of said joist element decreasing laterally outward from both longitudinal sides of said upper and lower flat surfaces in a direction perpendicular to the length of said joist element.

2. The joist of claim 1, wherein said upper and lower sides of the joist element each have a central portion comprising said longitudinally extending upper and lower flat surfaces respectively and a lateral portion on either side of said central portion, said lateral portions tapering laterally outward forming flat-bevelled surfaces on both the upper and lower sides of the joist element that extend toward each other from both longitudinal sides of said central portions.

3. The joist of claim 1, wherein the ratio of the thickness of the joist element to its width is from 1:4 to 1:5.

4. A resilient floor comprising a plurality of floor boards forming a floor surface extending in a first longitudinal direction, a plurality of parallel extending top joists on which said floor boards rest equidistantly spaced apart from each other and extending perpendicular to said floor boards, a plurality of parallel extending bottom joists on which said top joists rests equidistantly spaced apart from each other and extending perpendicular to the top joists and parallel to the floor boards, and a plurality of spaced apart blocks supporting said bottom joists on a base, said top joists having a thickness between an upper and lower side thereof and a width, an upper flat surface extending along the length of the upper side of the top joists, said upper flat surface forming a relatively narrow, compared to the width of said top joists, longitudinally extending, strip-shaped contact surface adapted to be engaged with a lower side of the floor boards and a lower flat surface extending along the length of the lower side of the top joists directly opposite from said upper flat surface, said lower flat surface forming a relatively narrow, compared to the width of said top joists, longitudinally extending, strip-shaped contact surface adapted to be engaged with an upper side of the bottom joists, the thickness of said top joists decreasing laterally outward from both longitudinal sides of said upper and lower flat surfaces in a direction perpendicular to the length of said top joists.

5. The resilient floor of claim 4, wherein said upper and lower sides of the top joists each have a central portion comprising said longitudinally extending upper and lower flat surfaces respectively and a lateral portion on either side of said central portion, said lateral portions tapering laterally outward forming flat-bevelled surfaces on both the upper and lower sides of the top joists that extend toward each other from both longitudinal sides of said central portions.

6. The joist of claim 4, wherein the ratio of the thickness of the top joists to its width is from 1:4 to 1:5.

* * * * *